US005813509A

United States Patent [19]

Boxall et al.

[11] Patent Number: 5,813,509

[45] Date of Patent: Sep. 29, 1998

[54] COIN GATE

[75] Inventors: Stephen Charles Boxall; Paul Robert Fletcher, both of Surrey, United Kingdom

[73] Assignee: Mars Incorporated, McLean, Va.

[21] Appl. No.: 793,649

[22] PCT Filed: Sep. 7, 1995

[86] PCT No.: PCT/GB95/02126

§ 371 Date: Mar. 5, 1997

§ 102(e) Date: Mar. 5, 1997

[87] PCT Pub. No.: WO96/07991

PCT Pub. Date: Mar. 14, 1996

[30] Foreign Application Priority Data

Sep. 9, 1994 [GB] United Kingdom ..... 9418158

[51] Int. Cl.[6] ..... G07F 1/04

[52] U.S. Cl. ..... 194/203; 194/346

[58] Field of Search ..... 194/203, 346, 194/347, 348, 349

[56] References Cited

U.S. PATENT DOCUMENTS

| | | | |
|---|---|---|---|
| 2,539,855 | 1/1951 | Nelson . | |
| 2,683,517 | 7/1954 | Gabrielsen | 194/203 |
| 3,998,309 | 12/1976 | Mandas et al. | 194/203 |
| 4,298,116 | 11/1981 | Niemeyer | 194/203 |
| 4,327,824 | 5/1982 | Nicholson | 194/203 |
| 4,918,724 | 4/1990 | Vogl et al. | 194/203 |

FOREIGN PATENT DOCUMENTS

| | | | |
|---|---|---|---|
| 0070353 A1 | 1/1983 | European Pat. Off. | 194/203 |
| 0 499 137 A1 | 8/1992 | European Pat. Off. . | |
| 2 213 375 | 10/1973 | Germany . | |
| 594 940 | 1/1978 | Switzerland | 194/203 |
| 680 399 A5 | 8/1992 | Switzerland | 194/203 |
| 1168850 | 10/1969 | United Kingdom | 194/203 |
| 1 273 892 | 5/1972 | United Kingdom . | |
| 1 294 957 | 11/1972 | United Kingdom | 194/203 |
| 2224150 | 4/1990 | United Kingdom | 194/203 |
| 2 252 855 | 8/1992 | United Kingdom . | |

*Primary Examiner*—F. J. Bartuska
*Attorney, Agent, or Firm*—Fish & Richardson P.C.

[57] ABSTRACT

A movable gate member (34) of a coin gate (24) is provided with lugs (70) which extend downwardly from the gate member (34), at least partly in the direction of travel of a coin through the gate. The lugs (70) trap a tethered or captive coin by hooking the coin if the coin is pulled back towards the gate by its tether. The lugs (70) may have a ramp shape for urging the coin progressively away from the open edge of the gate member, and slots (76) may be formed in the gate member for receiving the tether.

16 Claims, 4 Drawing Sheets

COIN GATE

BACKGROUND OF THE INVENTION

This invention relates to a coin gate suitable for use in a coin mechanism for, for example, a coin-operated vending machine or games machine. The term "coin" is employed to mean any coin (whether valid or counterfeit), token, slug, washer, or other metallic object or item, and especially any metallic object or item which could be utilised by an individual in an attempt to operate a coin-operated device or system. A "valid coin" is considered to be an authentic coin, token, or the like, and especially an authentic coin of a monetary system or systems in which or with which a coin-operated device or system is intended to operate and of a denomination which such coin-operated device or system is intended selectively to receive and to treat as an item of value.

A known problem for designers has been to provide satisfactory fraud-prevention against the use of so-called captive coins or tethered coins. Such coins have attached to them a fine thread or wire by means of which the coin can be manipulated in the coin mechanism to enable the coin to be extracted once the coin has been accepted and a credit issued. It can sometimes also be possible to trigger repeated operation of the coin mechanism by manipulating the tether, after which the coin can then be pulled out by its tether.

Coin gates are used to control to which of a plurality of paths a coin will be routed, or sometimes to selectively block passage of a coin through the gate. A particular example of an important coin gate so far as tethered coins are concerned is the coin acceptance gate. The gate determines whether the coin is accepted into a store and a credit issued, or whether the coin is directed to a reject coin chute.

When a coin is deemed acceptable, the gate is opened to allow the coin to pass to the store, and the gate is then closed. However, it can sometimes be possible to pull a tethered coin back through the gate by pulling on the thread sufficiently firmly to force the gate open. This can be a particular problem if the thread interferes with the normal operation of the gate to prevent it from closing fully in the first place. Unless such withdrawal of the coin is detected and preferably prevented, the mechanism will not be secure against the use of tethered coins, and such a tethered coin may be used again to trigger more coin credits.

Designs are known in the art for providing one-way-only gates and for detecting the presence of a thread or wire attached to a coin. Designs are also known for sensing the direction of travel of a coin so that fraudulent manipulation can be detected. However, such designs can be complicated and may not be suitable for inclusion in an existing mechanism without requiring substantial modification or redesign of the mechanism.

U.S. Pat. No. 4 327 824 discloses a coin testing apparatus in which a pivoting L-shaped member is positioned such that a coin entering a passageway pivots the member out of position before the coin travels along the passageway and operates an electrical switch. If an attempt is made to withdraw the coin by means of a tether, the member will have pivoted back into the passageway and prevents the coin from being withdrawn to a position at which the switch is de-actuated. The surface of the member which is engaged by the coin as it is withdrawn is provided with serrations, which aid in wedging the coin and preventing its withdrawal.

CH-A-680 399 discloses a coin gate in the form of a shutter which can be moved between a first position, in which a coin can travel through the shutter, and a second position in which a blocking portion of the shutter prevents the coin from moving past. The blocking portion is provided with openings which extend from the side of the blocking portion past which coins travel in the open position of the gate such that, when the gate is closed after a coin on a tether has moved past, the tether will be located within an opening. Upwardly projecting barbs adjacent the openings ensure that the tether is trapped. In this way, any attempt to withdraw the coin will be prevented by the coin striking against the shutter.

SUMMARY OF THE INVENTION

Aspects of the present invention are set out in the accompanying claims.

With arrangements according to the invention, even if the tether prevents the gate from closing fully, or if the gate tends to be pulled open by the tension in the tether, the coin can be held securely by, or behind, a hooking portion of the gate and thus be prevented from being able to be forced past the gate.

Preferably the coin gate comprises a movable blocking member having a side past which coins are allowed when the gate is in an open position, and the hooking portion is arranged so that, if a coin is pulled back towards the gate by its tether, the coin is guided progressively away from said side of the blocking member as the coin approaches the gate and towards a position in which the coin is trapped under the blocking member.

With such an arrangement, a tethered coin can be prevented from reaching the side of the blocking member, and thus prevented from being able to be forced past the gate by the tether.

Preferably, a plurality of hooking portions are provided, at spaced apart positions on the gate member.

The hooking portion preferably comprises a ramp-shaped lug, directed downwardly from the gate member. In the preferred embodiment, a number of spaced apart lugs are provided to engage a said tethered coin, and to allow the tether to be received therebetween to draw the coin against the surfaces of the lugs.

One or more openings, for example slots, may be formed in the blocking member, to allow the tether of a tethered coin to be received in an opening. For example, such openings may be formed between adjacent lugs if a plurality of lugs is used. Such an arrangement can allow the tether to adopt a position to draw the tethered coin into more positive engagement with the lugs or other means. For example, in the case of ramp-shaped lugs, the slots or openings may allow the coin to be drawn all of the way along the ramp surface, to direct the coin fully away From the edge of the blocking member.

In the preferred embodiment, the gate is pivoted between its open and closed positions. However, the invention may advantageously be applied to other forms of pivotable or slidable or retractable coin gates.

The aforementioned lugs or other means may be formed integrally with the portion of the gate from which it, or they, extends or extend, respectively. In the preferred embodiment, the gate is integrally formed and is made of moulded plastics material.

BRIEF DESCRIPTION OF THE DRAWINGS

An embodiment of the invention is now described by way of example with reference to the accompanying drawings, in which.

DESCRIPTION OF THE PREFERRED EMBODIMENTS

Figure 1:
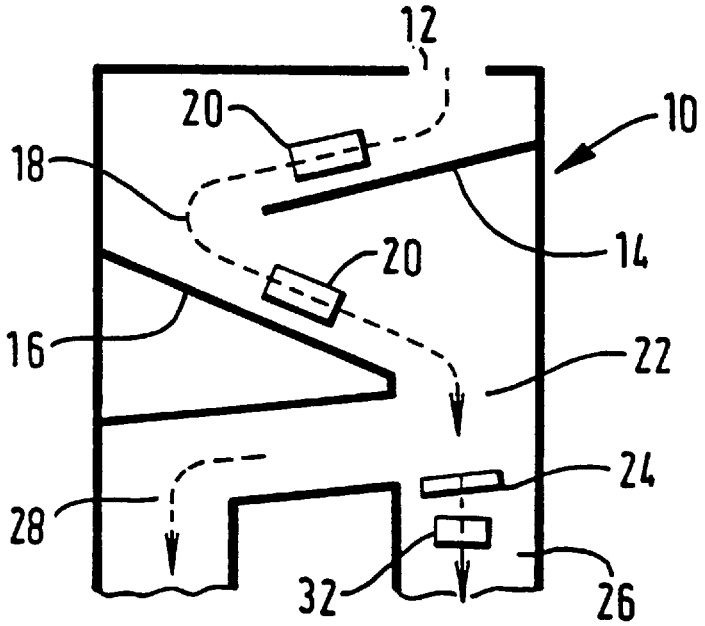
FIG. 1 is a schematic view of a coin mechanism including a coin acceptance gate.

Referring to FIG. 1, a coin validator mechanism 10 includes a coin entry slot 12, and first and second downwardly inclined runways 14 and 16 respectively, along which an inserted coin rolls, as shown by the broken line 18. Conventional coin recognition sensors 20 are arranged to sense the coin as it travels along the runways 14 and 16. A short chute 22 leads downwardly from the end of the second runway 16 to an electrically operated coin acceptance gate 24 which determines whether the coin is allowed to pass to an accept chute 26 or whether the coin is diverted to a reject chute 28. The acceptance gate 24 is controlled by control circuitry (not shown) which monitors the outputs from the sensors 20 to determine whether or not an inserted coin is acceptable. The accept chute 26 leads to a coin store (not shown), and a post-gate sensor 32 is arranged in the accept chute 26 to sense coins once they have passed through the acceptance gate 24.

Referring to FIGS. 2–6, the coin acceptance gate in this embodiment consists of a movable gate member 34 which is integrally formed of moulded plastics. Viewed from the side, the gate member 34 is generally L-shaped and consists of a lower gate portion 36 which is supported from a shaft 38 by struts 40*a–e*. The lower portion 36 includes four walls 42,44,46 and 48 which define a narrow, generally rectangular opening 50. A shelf 52 projects from one of the longer walls 42, and forms a blocking member as explained below. The wall 42 thus constitutes one side of the shelf 52, and at the opposite side the shelf 52 is turned upwardly to form a lip 54. The outermost struts 40*a* and 40*e*, and the centre strut 40*c* are generally parallel, but the struts 40*b* and 40*d* on either side of the centre are inclined inwardly towards the shaft 38 and join the centre strut 40*c* at the shaft 38. The shaft 38 is longer than the lower portion 36 and projects thereabove at one end 38*a*. An actuator lug 56 is formed on the projecting portion of the shaft 38 for coupling to an actuator (shown schematically at 57 in FIG. 5).

Figure 2:
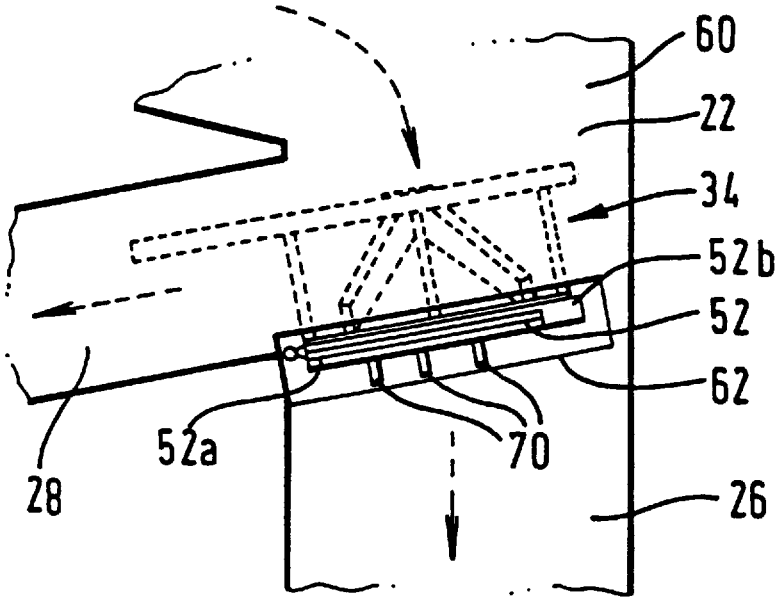
FIG. 2 is a more detailed view of the gate shown in FIG. 1.
Figure 3:
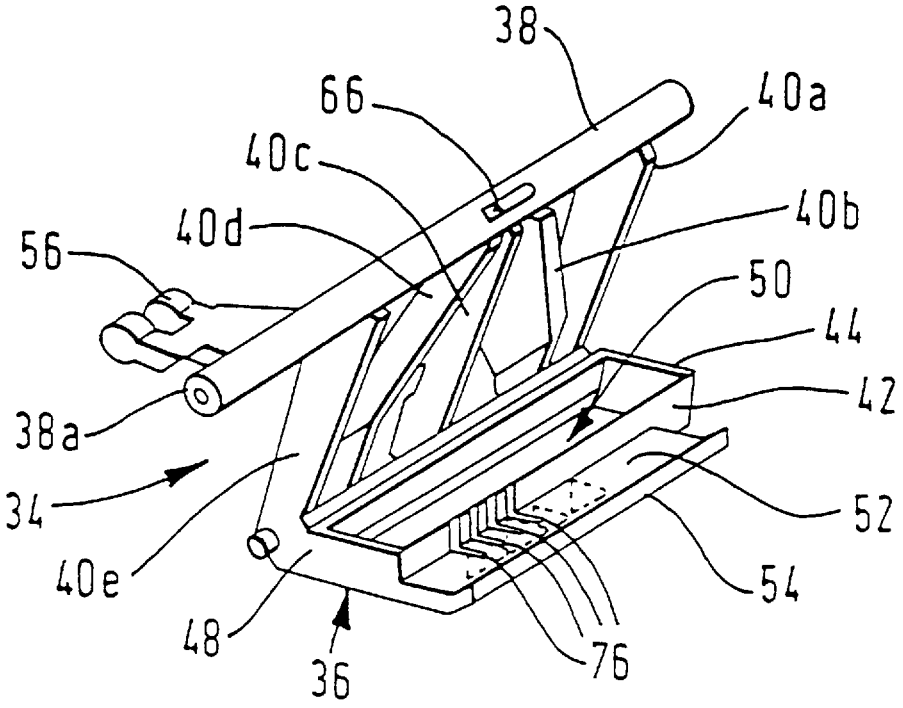
FIG. 3 is a perspective view from above of the gate member in isolation.
Figure 4:
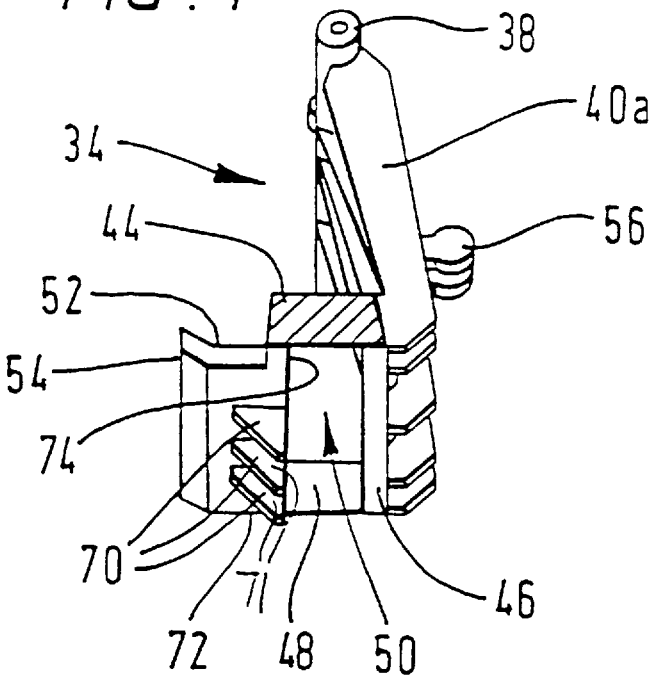
FIG. 4 is a perspective view from below of the gate member in isolation.
Figure 5:
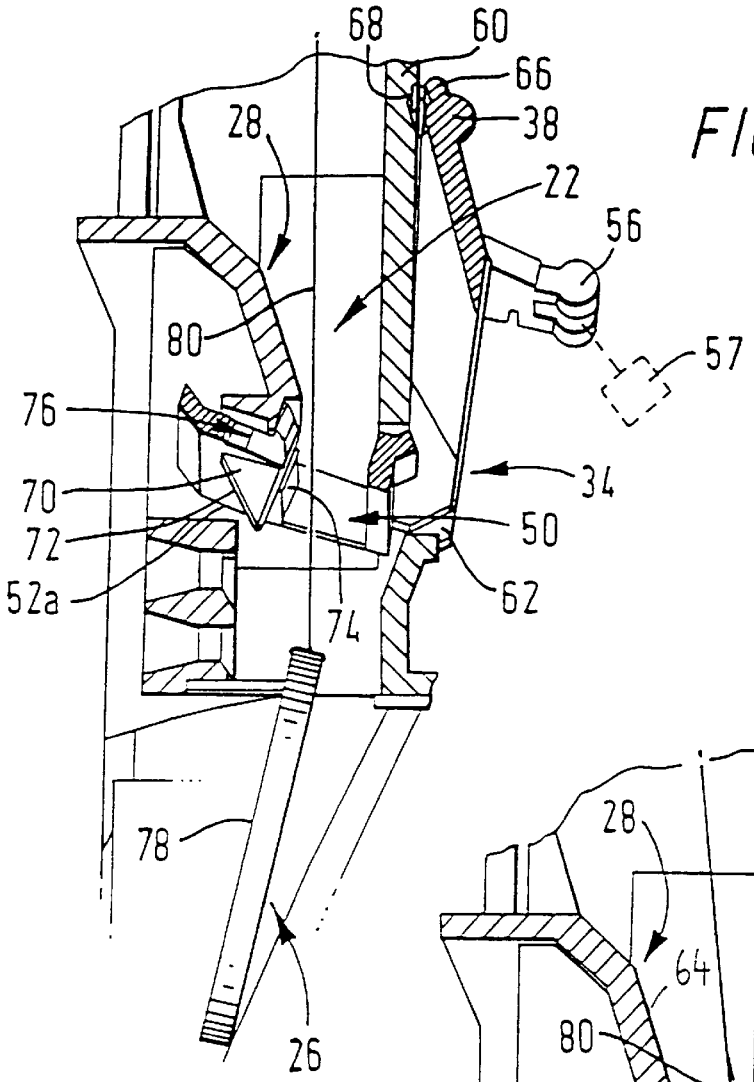
FIG. 5 is a schematic sectional view of the coin acceptance gate in its opened position.
Figure 6:
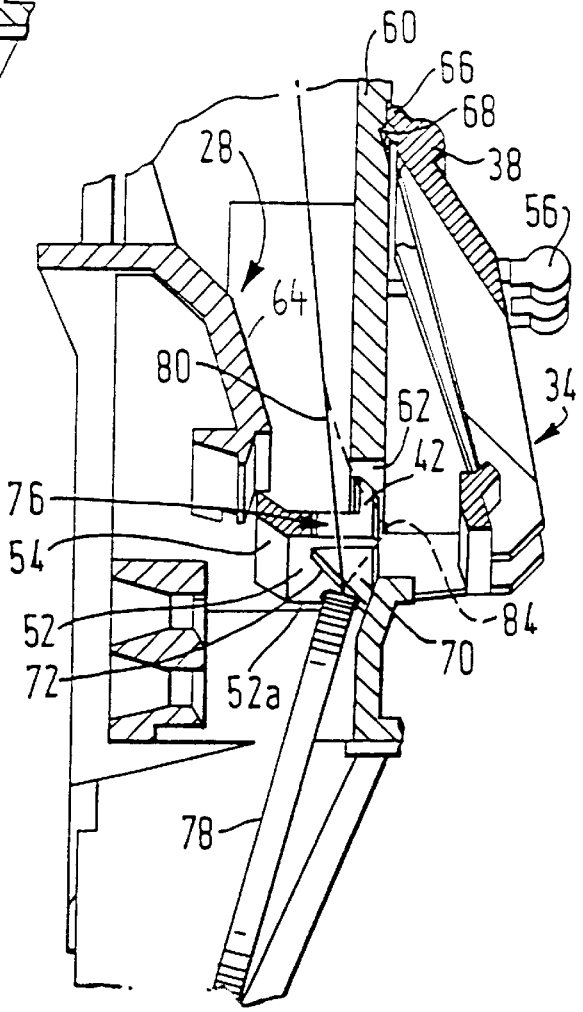
FIG. 6 is a schematic sectional view of the coin acceptance gate in its closed position.

As best seen in FIGS. 5 and 6, the gate member 34 is supported by its shaft 38 behind a wall 60 of the coin mechanism, such that the lower portion 36 projects through an opening 62 in the wall 60. The shaft 38 is rotatably mounted relative to the coin mechanism, such that the gate member 34 can swing relative to the wall 60 between an open position (as shown in FIG. 5), and a closed position (as shown in FIG. 6). As depicted in FIG. 2, and as can be seen from the underside angle of the gate member 34 in FIGS. 5 and 6, the gate member 34 is mounted relative to the wall 60 such that one end 52*a* of the shelf 52 adjacent to the reject chute 28 is lower than the other end 52*b* of the shelf. In the present embodiment, this inclination is achieved by mounting the shaft 38 at an angle relative to the horizontal of the coin mechanism, such that the gate member 34 is inclined relative to the horizontal. The reason for this inclination is explained hereinafter.

Referring to FIG. 5, in the open position of the gate member 34, the opening 50 is aligned substantially in register with the chute 22. Thus a coin dropping downwardly from the second runway is allowed to pass through the opening 50 and, after exiting the gate, to descend the accept chute 26 to the coin store. The opening 50 is dimensioned to allow therethrough the largest coin with which the gate is intended to be used.

Referring to FIG. 6, in the closed position of the gate member 34, the shelf 52 is aligned substantially in register with the chute 22 to block the passage of coins, and hence prevent the coins from entering the accept chute 26. The wall 42, the shelf 52 and the lip 54 together define a runway channel for the coin, guided also by the wall 60 of the coin mechanism, and a front wall 64. Owing to the downward inclination of the shelf 52 towards the reject chute 28, a coin landing on the shelf 52 will roll downwardly to be directed to the reject chute 28.

As mentioned above, the gate member 34 is driven by an actuator 57 which rotates the shaft 38 by means of the actuator lug 56. The actuator is preferably controlled electrically and may, for example, be an electromagnetic actuator. The actuator is driven in response to the output generated by the sensors 20 to determine whether or not the gate should be opened to accept the coin. If the gate is opened, the coin operates the post gate sensor 32 to deactivate the actuator to allow the gate to close. Additionally, a failsafe time-out count is performed to deactivate the actuator after a predetermined time even if no output is received from the post-gate sensor 32.

In this embodiment, the gate member 34 is biased towards its closed position (as a failsafe), and the actuator is used to open the gate member 34, the gate member 34 then returning to the closed position under the bias after operation of the actuator. The return bias may, for example, be provided by a return spring. Alternatively, the gate member 34 may be mounted such that it tends to return to the closed position under its own weight. To prevent the gate member 34 from moving beyond a maximally closed position, a small stop projection 66 is formed on the shaft 38 and engages an abutment surface 68 on the wall 60 when the gate member 34 is at the fully closed position.

Formed on the underside of the shelf 52 of the gate member 34 adjacent to the wall 42 are a number of spaced apart triangular lugs 70 with intervening spaces or openings 71; three lugs in this embodiment. The lugs 70 extend from the gate member at least partly in the direction of travel of a coin through the gate; the lugs extend generally downwardly in this embodiment. Each lug 70 is arranged to provide a ramp surface 72 tapering towards the lip 54. Each lug 70 is substantially flush with the inner face 74 or edge of the wall 42. The purpose of the lugs 70, as explained in more detail below, is to hook a tethered coin under the gate member 34 and retain the coin therebehind, if a person pulls on the tether to try to draw the coin back through the gate once the gate member 34 has moved towards its closed position. To supplement the openings 71, a group of thread capturing slots 76 are formed in a portion of the wall 42 towards one end. Each slot 76 extends through the wall 42 and partway into the shelf 52. Each slot 76 is wider at its open mouth than at its closed end, and the portions of the wall 42 between adjacent slots 76 are generally rounded such that, in use, a thread or wire extending through the opening 50 will tend to enter one of the slots 76 when the gate member 34 is moved to its closed position.

Referring to FIG. 5, it will be seen that when the gate member 34 is in its open position, the lugs 70 are positioned such that they do not hinder the passage of a coin through the opening 50. If, for example, a person enters a valid but tethered coin 78 into the coin mechanism, the gate member 34 will be controlled to move to its open position to accept the coin in the normal way. Thereafter, on closing of the gate member 34 (see FIG. 6), the movement of the gate member 34 together with the tension in the thread 80, is likely to cause the thread 80 to enter one of the slots 76. It will be appreciated that in FIG. 6, for clarity, the section line is taken through one particular slot 76 in which the thread 80 is received.

If the person now attempts to withdraw the coin by forcing the coin 78 upwardly through the gate by pulling on the thread 80, the edge of the coin 78 will abut the ramp surface 72 of at least one of the lugs 70. Further pulling on the thread 80 will cause the coin to be guided by the respective lugs 70 away from the opening (see FIG. 7), such that the coin 78 is trapped by the lugs 70 adjacent to the underside of the extension 52 of the gate member 34. Continued pulling on the thread 80 may cause the gate member 34 to open partially (see FIG. 8), but this merely causes the coin to be trapped more firmly, between the lugs 70 of the gate member and a wall 82 formed on the coin mechanism below the gate member 34.

Figure 7:
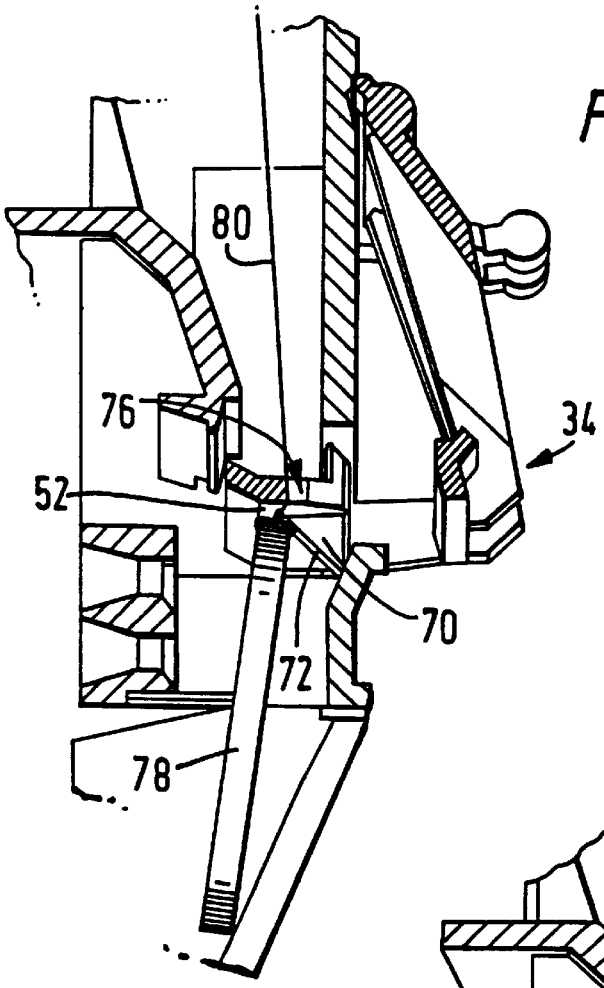
FIGS. 7 and 8 are schematic sectional views similar to FIG. 6 but showing the effect of a tethered coin being drawn against the gate.
Figure 8:
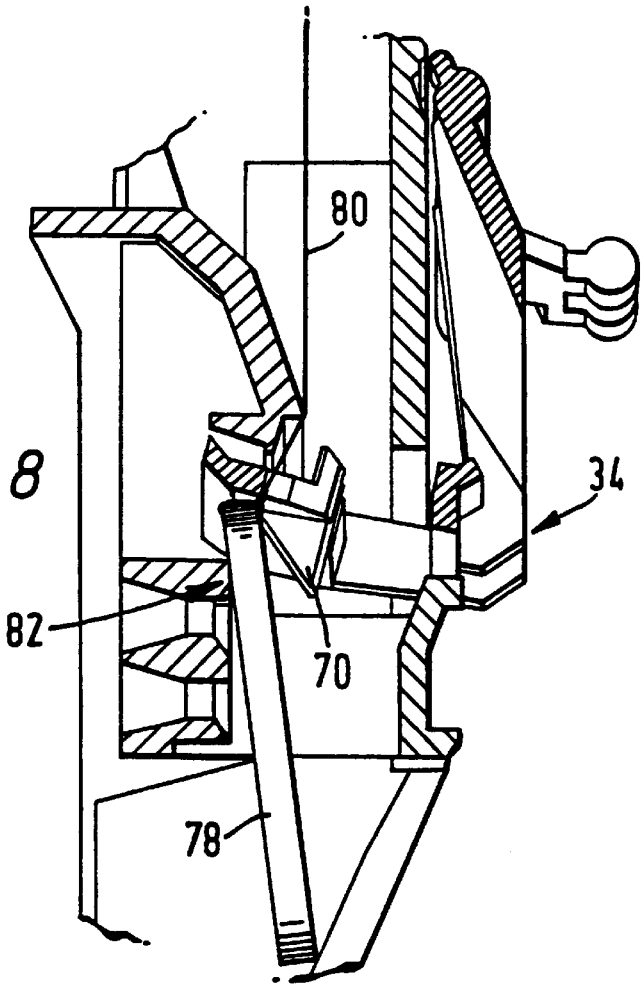

The slots 76 allow the thread 80 to adopt a position in which the pulling force of the thread 80 is directed behind the lugs 70 to draw the coin 78 upwardly along the ramp surface 72 of one or more of the lugs 70. In FIGS. 6, 7 and 8 the position of the thread 80 moves to the left as the coin 78 is drawn nearer the underside of the shelf 52. The length of each slot 76 into the shelf 52 is such that the closed end of the slot 76 is approximately in line with the ends of the ramp surfaces 72. This means that when the coin 78 bears against the underside of the shelf 52, the pulling force provided by the thread is directed substantially upwardly, thereby ensuring that the coin 78 is retained securely behind the lugs 70. In fact, the coin 78 is trapped more firmly the harder the person pulls on the thread 80.

As depicted by the broken line 84 in FIG. 6, if the thread 80 does not enter one of the slots 76, the coin 78 is still able to bear against at least one of the lugs 72 as the thread 80 is pulled upwardly, such that the coin 78 will be hooked, or trapped, in a similar manner to that described above. However, the thread 80 will extend to the right as seen in FIG. 6, through the space 71 between the lugs and towards the opening 50, instead of generally vertically upwardly as in the case of the thread 80 entering a slot. Owing to the direction of the pulling force, the coin 78 will be retained by the lugs 70, but the coin 78 might only be drawn part of the way up the ramp surfaces 72 of the lugs 70 instead of fully against the underside of the extension 52.

If the thread 80 shears or is released by the person, the coin 78 becomes free to drop down the accept chute 26 as originally intended. The gate member 34 will then return under its bias to the closed position.

In the present embodiment, the slots 76 are arranged only in a region of the wall 42 towards one end. Owing to the geometry of the first and second runways 14 and 16, and of the chutes 22 and 26, the fall-line which the thread 80 will adopt when supporting the weight of the coin 78 can be roughly predicted. In this embodiment, the fall line of the thread will lie towards the end of the opening 50 adjacent to the reject chute 28, and this is the region in which the slots 76 are arranged.

In other embodiments, slots may be provided in the wall 42 across the whole width of the opening 50 if this is desired. The configurations of the slots may be altered as desired. The slots could also be replaced by other openings or clearances in the wall 42, designed to allow the thread 80 of a tethered coin 78 to be directed away from the opening 50.

Alternatively, the slots 76, or similar opening or clearances, may be omitted from the gate member 34. As explained hereinbefore, the lugs 70 are able to hook a tethered coin 78 even without the slots 76, although the slots 76 offer advantages in combination with the lugs 70.

In the preferred embodiment described above, a number of discrete lugs 70 are provided. However, in other embodiments, the lugs may be replaced by other means or projections, directed at least partly in the direction of travel of a coin through the gate, for hooking or retaining a tethered coin 78 if it is drawn back towards the opening 50. For example, the wall 42 may be deepened to project below the level of the shelf 52; slots may be provided in the wall as appropriate. The wall may have a ramp profile extending away from the opening 50, similar to the ramp surfaces 72 of the lugs 70 described above.

Although the ramp surfaces 72 described above offer an advantage in guiding a tethered coin 78 progressively further away from the opening 50 as the coin 78 approaches the gate member 34, other lugs or projections may be provided without such a ramp surface or surfaces. For example, the lugs may each comprise a downwardly extending or downwardly angled tooth.

The preferred embodiment described above provides a simple, yet reliable, coin gate which is effective in preventing extraction of a tethered coin back through the gate once the coin has been accepted. It will be appreciated that, to achieve this, the gate does not rely on additional electronic sensors and additional control circuitry, nor does it require additional mechanical components to control movement of the gate. Accordingly, such a gate may be implemented in a coin mechanism without necessitating complicated modification or redesign of an existing mechanism.

It will be appreciated that the above description is merely illustrative of an exemplary embodiment, and that modifications may be made within the scope or principles of the invention.

We claim:

1. A coin gate comprising a blocking member (52) movable between an open position for allowing a coin to move past a side (42) of the gate, and a closed position for blocking the path of the coin, and trapping means (70,71,76) on the gate member adapted to trap a tethered coin (78) against the blocking member if the coin is pulled back from the gate exit towards the blocking member by its tether, said trapping means comprising an opening (71;76) extending away from said side (42) of the member for receiving the tether, wherein the trapping means further comprises a coin hooking portion (70) located on said blocking member (52) and extending therefrom at least partly in the direction of travel of a coin through the gate, the opening (71,76) and the hooking portion (70) being so arranged that as the tethered coin is pulled back with the tether located in the opening, the hooking portion (70) is located between the coin (78) and said side (42) of the blocking member.

2. A coin gate according to claim 1, wherein the hooking portion (70) is adapted to guide a coin (78) progressively away from the side (42) of the blocking member (52) as the coin approaches the blocking member.

3. A coin gate as claimed in claim 1, wherein said opening (71) is located laterally adjacent said hooking portion (70).

4. A coin gate as claimed in claim 3, including a further opening (76) extending through the blocking member (52) such that the tether of a trapped coin (78) can extend through both said openings (71,76).

5. A coin gate according to claim 4, wherein said hooking portion (70) comprises a front surface proximate the side (42) of the blocking member (52) and an opposite, rear surface (72), and the further opening extends rearwards from said side (42) to a position behind said front surface of said portion.

6. A coin gate according to claim 4, wherein the further opening (76) comprises a slot.

7. A coin gate according to claim 1, wherein a plurality of such trapping means are distributed along the blocking member (52).

8. A coin gate according to claim 1, wherein the hooking portion (70) is capable of engaging a said tethered coin (78) when the blocking member (52) is at an intermediate position between the open and closed positions.

9. A coin gate according to claim 1, wherein the hooking portion (70) is directed generally downwardly from the blocking member (52).

10. A coin gate according to claim 1, wherein the hooking portion (70) is positioned adjacent to said side (42) of the blocking member (52).

11. A coin gate according to claim 1, the gate being operable for selectively permitting and preventing coins from passing therethrough to the gate exit.

12. A coin gate according to claim 1, further comprising actuator means (57) for controlling the position of the blocking member (52).

13. A coin gate according to claim 12, wherein the actuator means (57) is controlled electrically.

14. A coin gate according to claim 1, wherein the blocking member (52) is resiliently biased to a predetermined operating position.

15. Coin-handling apparatus comprising a coin gate, the coin gate comprising a blocking member movable between an open position for allowing a coin to move past a side of the gate, and a closed position for blocking the path of the coin, and trapping means on the gate member adapted to trap a tethered coin against the blocking member if the coin is pulled back from the gate exit towards the blocking member by its tether, said trapping means comprising an opening extending away from said side of the member for receiving the tether, wherein the trapping means further comprises a coin hooking portion located on said blocking member and extending therefrom at least partly in the direction of travel of a coin through the gate, the opening and the hooking portion being so arranged that as the tethered coin is pulled back with the tether located in the opening, the hooking portion is located between the coin and said side of the blocking member.

16. Coin handling apparatus as claimed in claim 15, wherein the coin gate is an acceptance gate for routing a coin to an accept path (26) or to a non-accept path (28).

* * * * *